United States Patent [19]

Read

[11] Patent Number: 4,998,625

[45] Date of Patent: Mar. 12, 1991

[54] RIPRAP SEPARATION APPARATUS AND METHOD

[75] Inventor: James L. Read, Middleboro, Mass.

[73] Assignee: The Read Corporation, Middleboro, Mass.

[21] Appl. No.: 260,592

[22] Filed: Oct. 21, 1988

[51] Int. Cl.[5] ..... B07B 9/00; B07B 1/28

[52] U.S. Cl. ..... 209/234; 209/235; 209/240; 209/260; 209/412

[58] Field of Search ..... 209/234, 235, 240, 241, 209/243, 244, 255, 260, 341, 352, 370, 379, 409, 412, 420, 421, 44.1, 629, 632, 633, 634, 659, 675; 414/376

[56] References Cited

U.S. PATENT DOCUMENTS

| | | | |
|---|---|---|---|
| Re. 6,211 | 1/1875 | Roberts | 209/240 |
| 1,510,742 | 10/1924 | Gutleben | 209/420 |
| 2,107,532 | 2/1938 | Hallenbeck | 209/260 |
| 2,396,954 | 3/1946 | Kranz et al. | 209/260 |
| 2,690,840 | 10/1954 | Kohlmier | 209/260 |
| 2,883,050 | 4/1959 | Windolph | 209/44.1 |
| 3,307,698 | 3/1967 | Haffner | 209/420 X |
| 3,402,816 | 9/1968 | Taylor | 209/260 |
| 4,059,195 | 11/1977 | MacDonald et al. | 414/376 |
| 4,197,194 | 4/1980 | Read | 209/421 X |
| 4,299,695 | 11/1981 | Bostrom | 209/260 |

FOREIGN PATENT DOCUMENTS

| | | | |
|---|---|---|---|
| 2948273 | 10/1980 | Fed. Rep. of Germany | 209/379 |
| 1555028 | 11/1979 | United Kingdom | 209/379 |

*Primary Examiner*—Margaret A. Focarino
*Assistant Examiner*—Edward M. Wacyra
*Attorney, Agent, or Firm*—Richard P. Crowley

[57] ABSTRACT

A riprap separation apparatus and method which riprap apparatus comprises a frame having an open space within the frame, an upper grizzly section composed of a tiltable upper grizzly section having a plurality of fixed, spaced apart bar elements so that riprap material discharged onto the grizzly section is separated into a large size material and a smaller size material which passes through the bar elements and a downwardly angled discharge chute to receive the larger size material and to deposit the large size material to one side of the apparatus. The apparatus includes a support section disposed to be within an earthen sloped access ramp to provide support for the apparatus and with the ramp to provide for the movement of vehicles to discharge riprap material into the grizzly section. The separation apparatus includes a soil separating apparatus within the open space of the frame to receive the smaller size riprap material and to separate the smaller size riprap into an intermediate size material to be deposited to other side of the separation apparatus and a finer size material within the open space and beneath the soil separating apparatus.

14 Claims, 3 Drawing Sheets

RIPRAP SEPARATION APPARATUS AND METHOD

DESCRIPTION

Background of the Invention

A riprap material composed of rock and granite of large to small size often admixed with soil and stumps, etc. is quite difficult to separate and often must be separated in a series of separate steps and by separate apparatus. Typically, riprap material is separated by employing a fixed plurality of spread apart, horizontal bar elements to provide for the separation of riprap material into a very large size material, such as rocks and granite over for example 12" to 18" in size, and a smaller size material of less than 9" to 18" in size. Thereafter, the smaller size material is removed and subject to other separating-type techniques to segregate the soil. One of the difficulties of separating riprap material is that the larger size material often tends to become stuck on the upper horizontal surface of the bar elements and must be removed periodically by hand.

Riprap material cannot be employed with typical soil screening apparatus directly such as the double shaker-type screening apparatus and techniques described for example in U.S. Pat. Nos. 4,197,194, 4,237,000, 4,256,572 and 263,836 (design). The discharge of such riprap material directly onto the upper shaker screen of such shaker-type screen apparatus may cause damage to the shaker screen apparatus and in any event would provide only two separated, classified size materials. Therefore, it is desirable to provide for separation of riprap material in an economical, efficient manner by a single apparatus and method into at least three separate selected size classified materials.

SUMMARY OF THE INVENTION

The present invention relates to a riprap separation apparatus and method, and in particular concerns a riprap separation apparatus and method in combination with a shaker soil separating screen apparatus to provide for the economical and efficient separation of riprap material into at least three separate selected size classified materials.

A riprap separation apparatus has been discovered together with a method for the economic and efficient separation of riprap material into at least three separate, selected size classified materials which riprap separating apparatus and method overcomes the disadvantages of the prior art. The riprap separation apparatus comprises a support frame so designed to provide an open internal space within the support frame in order to receive therein a soil or rock separating means in the open space of the frame, such as for example, a loam soil screening apparatus known as the Read Screen-All® apparatus (a trademark of The Read Corporation of Middleboro, Mass., and is described and disclosed more particularly in the cited U.S. patent supra in the Background of the Invention and incorporated herein by reference. However, any soil, loam or rock separating means may be used in the open space provided such apparatus would provide for the separate and distinct classification of the receiving material into two separate classified piles of material.

The upper section of the support frame defines a grizzly-type element which grizzly element comprises a hopper means to direct riprap material so received generally into the central area of the grizzly element. The grizzly element comprises a plurality of generally parallel, spaced apart, horizontally fixed bar elements to separate the received riprap material into large riprap material which does not pass through the open spaces of the bar elements and smaller riprap-soil material which is permitted to pass through the spaces of the bar elements downwardly into the open space of the support frame to be directed by inside hoppers into the receiving section of the separate soil or loam receiving apparatus within the open space for further classification. The grizzly element also importantly contains a means to tilt the grizzly element on an axis between defined angular limits, such as from a horizontal position which is generally parallel to the ground to a higher angle, for example, 75° or less and more typically to range between about 25° and 60° from the horizontal. The tilting of the grizzly element is important in order to aid in removal periodically of large riprap material from the surface of the spaced apart bar elements by such angle and movement which large riprap material often gets stuck in the bar elements and is prevented from doing so by periodically angularly moving the bar elements. Also, the angular position of the grizzly bar elements provides an angular, sloping surface for the discharge of the first larger size riprap material, that is, the material which fails to pass through the bar elements to a slide plate on the one side of the riprap separating apparatus therefore to form a segregated pile of said first riprap material on the ground outside of the support frame.

The riprap separating apparatus is typically positioned so as to provide an angled discharge ramp whereby vehicles, such as dump trucks containing the riprap material to be separated, may proceed up the ramp, discharge the material directly from the truck onto the angled grizzly bar elements at the upper portion of the support frame. Of course, where discharging trucks or the discharging apparatus do not need to use the ramp, then the open support frame may be positioned in such a manner to receive the riprap material to be separated without the need for the ramp. Generally then where a ramp is employed with the riprap separating apparatus, support means are provided such as fixed bars or wings, to provide support within the earthen ramp, that is, generally a number of fixed wing elements extending outwardly from front side of the support frame which are adapted to be covered by the earth forming the ramp or to be secured in some manner to the ramp thereby providing a very fixed support frame with the support frame adjacent the ramp.

The upper grizzly element also contains generally a pair of upwardly extending side elements from the grizzly element on either side of the receiving grizzly element in order to aid in directing the discharged riprap material to be separated onto the grizzly bar elements and to prevent the riprap material from falling on either side of the support frame. In addition, the riprap separating apparatus contains a pair of inwardly angled hoppers and positioned below and on either side of the spaced apart grizzly bar elements and secured to the upper section of the open support frame and just above the loam or soil separating apparatus so as to direct the relatively small riprap material passing through the bar elements of the grizzly element on a defined downward path into the open space of the frame and into the upper receiving section of the loam and soil apparatus.

The riprap separating apparatus also contains an angled discharge ramp to receive the riprap material which does not pass through the bar elements and to discharge this larger-type riprap material as a first riprap material from the upper section of the grizzly bar elements and outside of the support frame. Typically such an angled discharge ramp may include for example a heavy core of wood, such as oak, for resilience and a solid laminated steel plate on the upper surface thereof generally at an angle of 30° to 60° with the lower lip of the ramp extending toward the outside back of the frame or outside of the support frame so as to direct the larger riprap material not separated to a defined section immediately outside of the support frame.

The riprap separating apparatus and method thereby provides for a simple yet effective means of combining tiltable, open space, grizzly bar elements on a support frame with a loam or soil separating apparatus, either immobile or portable, and provides for easy dumping through the use of a ramp of large riprap material directly onto the bar elements, thereafter having the material passing the bar elements to be separated and classified by the loam or soil apparatus within the open space of the support frame into separate, distinct classified size materials.

The invention comprises a method of separating riprap material composed of a wide variety of soil, rocks and miscellaneous material into three separate distinctly sized classified solid material, which method comprises: discharging riprap material to be separated onto a tiltable grizzly section composed of a plurality of spaced apart, fixed bar elements disposed at an angle to the ground to provide for the passage of the smaller riprap material through the bar elements downwardly into the open space within a support frame and the retention and discharge of the relatively larger size riprap material, such as for example anything greater than 12 inches in size to one side and outside of the support frame. The method includes the separating of the material received by the soil or loam apparatus within the open space of the support frame into separately classified solid material, such as for example, material having a size between 8 and 12 inches, for example to one side, and a smaller size having less than 8 inches within the open space of the frame. Of course, as desired, the classification of the material into any particular size may be varied by varying the spaces of the bar elements and by selection of the particular screening soil separating apparatus to be used within the open space of the support frame. Importantly, the method includes tilting at a defined angle the grizzly section to aid in discharging the larger size riprap material from the surface of the bar elements and periodically for example to tilt the grizzly segment at a steeper angle to discharge from the bar elements any larger size material which may be stuck within the open spaces of the bar elements.

The invention will be described for the purposes of illustration only in connection with certain embodiments; however, it is recognized that those persons skilled in the art may make various changes, modifications, additions and improvements to the illustrated embodiment without departing from the spirit and scope of the invention.

BRIEF DESCRIPTION OF THE EMBODIMENTS

Figure 1:
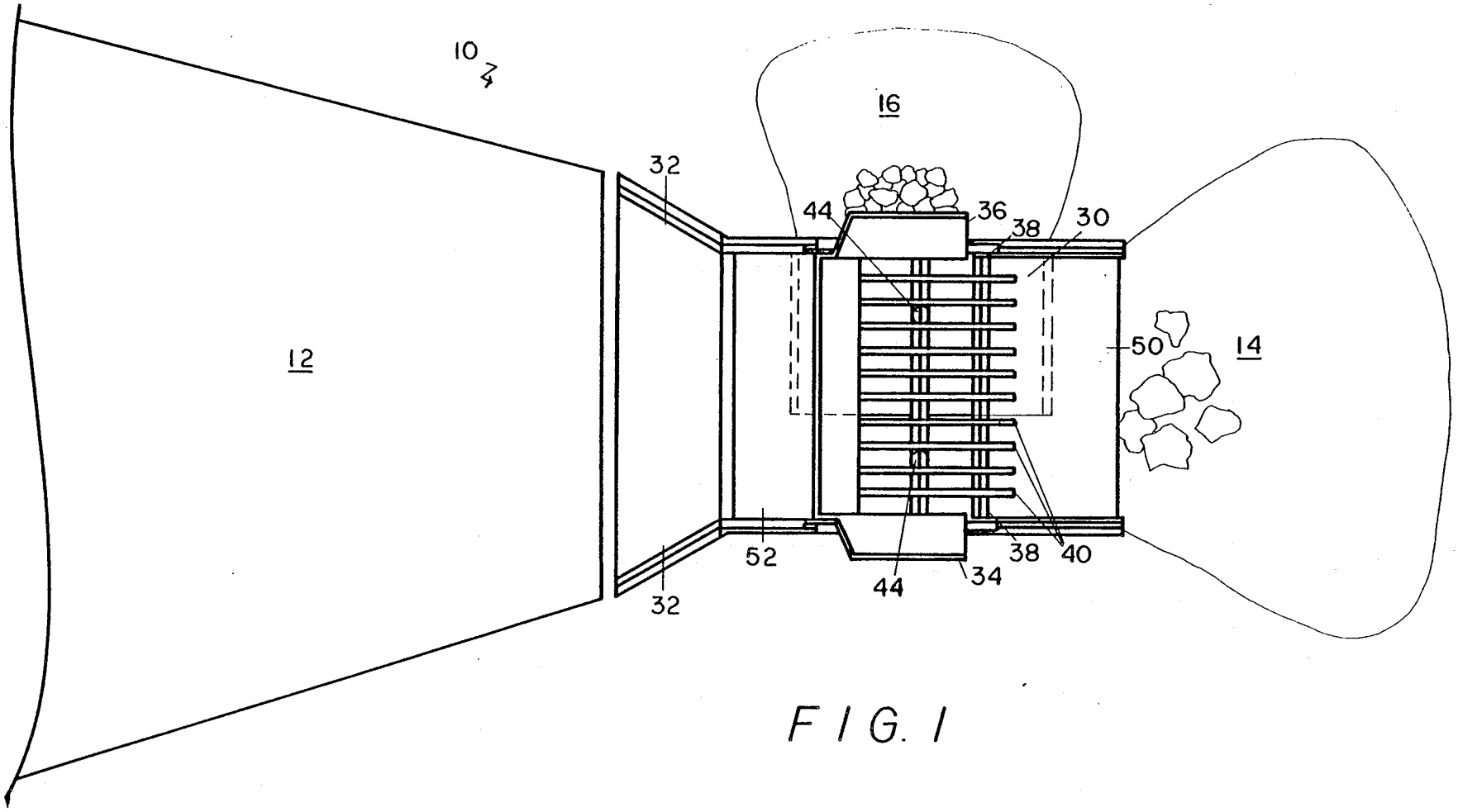
FIG. 1 is an illustrated top plan view of the riprap separating apparatus of the invention showing the riprap apparatus secured to an earthen ramp.

With reference to all of the drawings, the riprap separating apparatus 10 is shown wherein there is an angled earthen ramp extending to the apparatus 12, for example having a 48 foot ramp width at its base as minimum and a 21 foot ramp width at its top having a grade to permit the movement of vehicles with riprap material to be separated. As illustrated, the riprap material to be separated is defined into three separate defined classifications: a rock product 14 having a size of greater than generally 12 inches based on the settings as defined; a rock product 16 of about 8 to 12 inches in size; and a rock product 18 of less than 8 inches in size, all shown in a separate pile position, for example, rock product 14 outside at one end of the apparatus 10 opposite the ramp 12 and outside the back end of the apparatus 10 and rock product 16 to the one side of the riprap separating apparatus 10, while rock product 18 is illustrated as being within the open space and beneath a soil or loam screen-type separating apparatus 30. The apparatus 30 may be, for example, a double screen Read Screen-All® wherein the top screen is designed to separate riprap material and soil (8 to 12 inch) and to permit the smaller size material to fall through and become the rock product 18 in the open frame; however, if desired, a conveyor or other means can be used to convey the rock product 18 from within the open space of the frame to outside of the open frame.

The riprap separating apparatus comprises a support frame composing the support posts as shown 20, 22 and 24 with the remaining corner post not shown, having an upper support 26 all of which defines an open space 28 within the support frame. The support frame includes a wing support which comprises a plurality of generally horizontal, spaced apart bars extending from the front of the apparatus so that the wing elements 32 may be covered over by earth which forms the ramp 12 thereby providing for a very fixed, open support frame.

On the upper section of the support frame of the riprap separating apparatus is grizzly section which has solid, inwardly sloping grizzly side sections 34 and 36 in order to direct riprap material downwardly into the open, spaced apart bars 40 which are fixed in position and of a defined space and distance apart which are positioned on fixed grizzly supports 38. The grizzly sides sections 34 and 36 prevent the riprap material from being discharged, for example, from truck 54 and falling on either side of the support frame. The fixed grizzly support bars are typically railroad ties which are fixed in a defined position to the grizzly supports.

Figure 2:
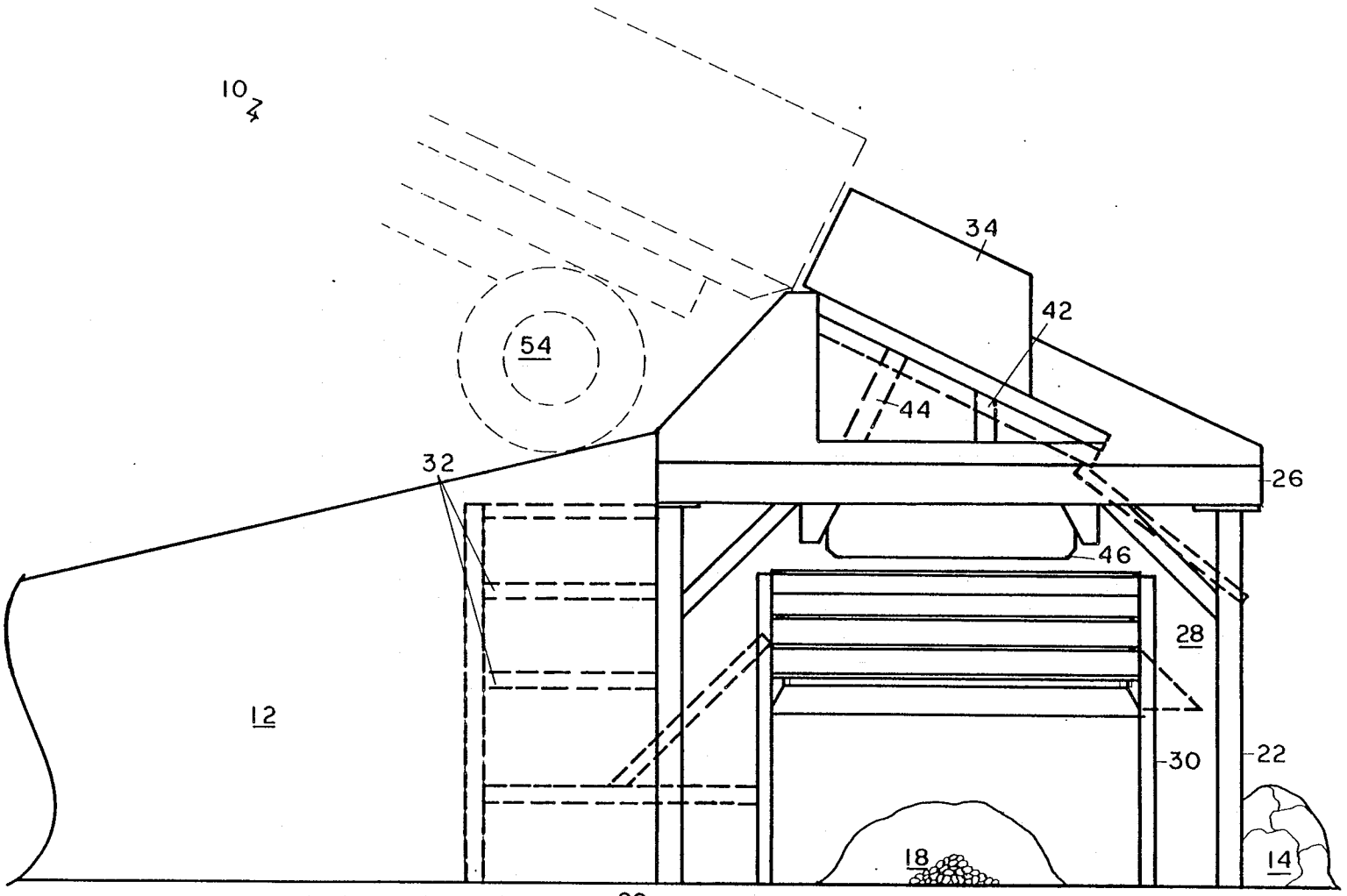
FIG. 2 is an illustrative side plan view of the riprap separating apparatus of FIG. 1 and a partial sectional view illustrating the position of a truck on the earthen ramp in a discharge position onto the upper grizzly.
Figure 3:
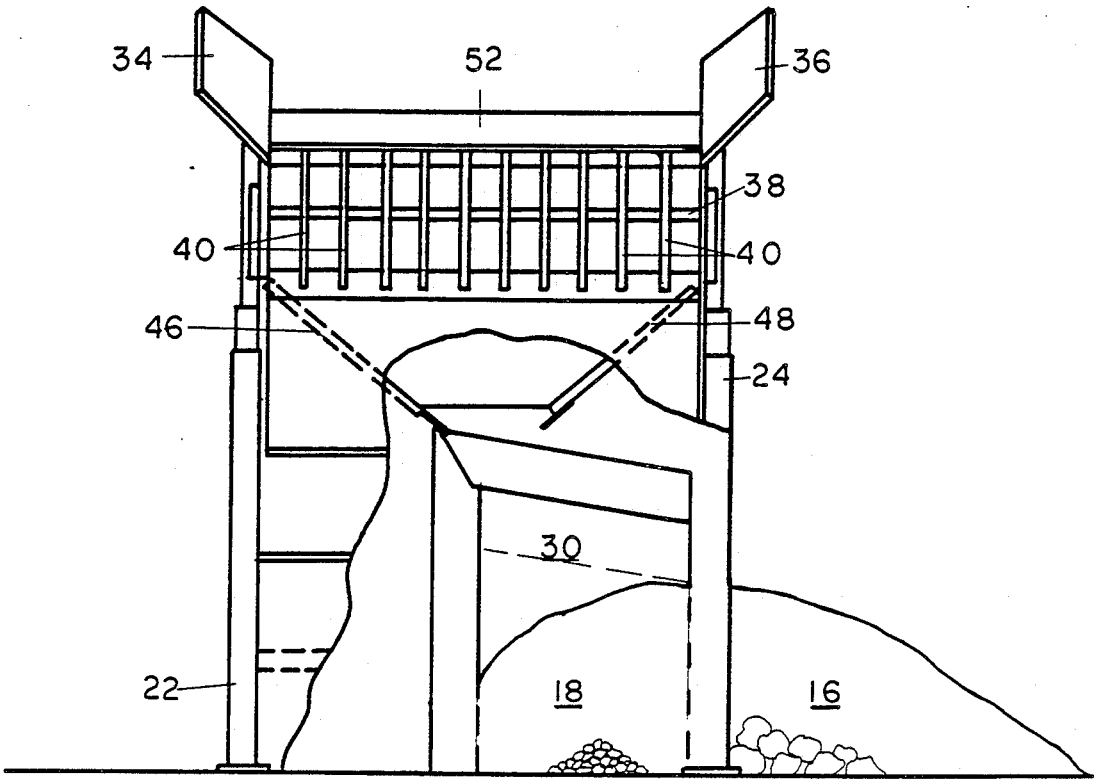
FIG. 3 is an illustrative back end plan view of the riprap separating apparatus of FIGS. 1 and 2.

The grizzly supports and bars are adapted to be mounted about a pivot axis 42 of one of the supports, for example, from 25° to 60°. As illustrated more particularly by the dotted line section of FIG. 2 wherein the solid line section shows the grizzly elements and the fixed bar elements 40 in its normal position in operation and dotted lines showing an upper angle position to remove periodically material caught in the fixed bar open spaces and the lower dotted line position at rest wherein the grizzly supports 38 are essentially parallel and horizontal to the ground. The grizzly support elements 38 are secured to a pair of hydraulic cylinders 44 and are tilted about the axis 42 which hydraulic cylinders operated by motor (not shown) move the upper grizzly section to the desired angular position.

The support frame also includes a riprap chute discharge means comprising a solid wood chute laminated to a top steel plate 50 at the back end of the grizzly, which chute discharge 50 is positioned underneath the grizzly and adapted to receive the larger size riprap material which did not pass through the open spaces of the fixed bar sections of the grizzly bars 40 and therefore to permit such material to be slidably discharged to the back side of the apparatus 10 to form rock product 14. Beneath the spaced apart grizzly bar sections 40 and on either side and generally directly beneath the grizzly side plates 34 and 36 are located solid, inwardly angled hoppers 46 and 48 typically having an angle of 30° to 60° which hoppers direct the riprap material falling through the grizzly bar elements 40 downwardly and into the upper receiving section of the loam screen separating apparatus 30 so that the material may be further classified into rock product 16 and 18. In the riprap separating apparatus as defined by the removal of the larger size rock product 14, this large size product is therefore not discharged directly onto the upper screen of the soil and loam separating apparatus, and therefore does not damage the loam and soil apparatus 30.

In use, the riprap separating apparatus is set up, an earthen ramp is built 12 to cover the wing elements 32 and to provide access for the trucks 54. The grizzly section with the fixed bar elements 40 is tilted by the hydraulic cylinder 44 to a defined angle, such as 30° or 40°, and then riprap material from trucks moving up the ramp is discharged directly onto the angled, fixed bar sections 40 of the grizzly, the larger size material sliding off the surface of the fixed bar elements 40 onto the solid ramp 50 to form the rock product 14 while the smaller size material which passes through the open bar sections 40 of the grizzly are directed downwardly by hoppers 46 and 48 onto the receiving screen or inlet of a soil/-loam separating apparatus 30 where a separate classification of this material takes place to form rock product 16 and 18.

What is claimed is:

1. A separation apparatus which apparatus comprises in combination:

(a) a support frame having a front, back and one and the other sides, with at least one side of said apparatus open to provide an open internal space within the support frame;

(b) an upper grizzly element on the top of the support frame having a one and other end, which grizzly element comprises:

(i) a first receiving hopper means to receive riprap-type material to be separated;

(ii) a plurality of generally parallel, spaced apart, horizontally fixed bar elements extending from the front toward the back of the support frame to separate the received riprap into the first large riprap material which does not pass through the spaces of the bar elements and small riprap material which passes through the spaces of the bar elements;

(c) means to tilt the grizzly element about an axis at the one end between a horizontal position and an upright angle of about 75° to aid in the removal of the first large riprap material from the surface of the bar elements by angular movement of the bar elements of the grizzly element and to provide an angular sloping surface for the discharge of the first large riprap material;

(d) a downwardly angled discharge ramp means adjacent the one end of the grizzly element and adapted to receive the first large riprap material from the grizzly bar elements and to discharge said large riprap material form the discharge ramp means into a separated first large riprap material of defined size on the ground adjacent the back of the support frame;

(e) a second receiving hopper means within the open space of the support frame to direct the small riprap material passing through the upper grizzly element on a defined downward path in said open space;

(f) support means to provide for attachment to a sloping earthen ramp means adjacent the apparatus;

(g) a sloping earthen ramp means to provide an angled ramp for the movement of vehicles and extending up to the first receiving hopper means to permit the discharge of riprap material from said vehicles directly into the first receiving hopper means; and (h) screen-type soil separating means within the said open space to receive said small riprap material from the second hopper means and to separate the small riprap material into a second riprap material and a third riprap material of defined sizes, the third material deposited and separated and reachable for the removal within the said open space and beneath the screen-type soil separating means, and the second material separately deposited and separated outside of the separation apparatus thereby providing an apparatus for the separation of the riprap material into at least three distinct, classified, separate materials.

2. The apparatus of claim 1 wherein the means to tilt includes a hydraulic means to permit the movement of the upper grizzly element about the axis between defined angular positions.

3. The apparatus of claim 1 wherein the support means comprises a plurality of generally horizontal, spaced apart, outwardly extending supporting bars and wherein the ramp means surrounds and emcompasses the supporting bars.

4. The apparatus of claim 1 wherein the screen-type soil separating means comprises a screening apparatus having a pair of spaced apart, angled upper and lower shaker screens, each of defined screening capacity, to receive the said small riprap material and to screen and separate the small riprap material into a separate pile of third material beneath the shaker screens and subject to removal from beneath the shaker screens and into a separate pile of second material outside of the screen-type separating means and adjacent to one or the other side of the separation apparatus.

5. The apparatus of claim 4 wherein the second receiving hopper means includes angled hopper surfaces extending inwardly and downwardly to receive the small riprap material and to direct the small riprap material onto the upper shaker screen of the soil separating means.

6. The apparatus of claim 1 wherein the first receiving hopper means comprises upright, outwardly angled hopper surfaces extending from the one and other sides of the support frame.

7. The apparatus of claim 1 wherein the angled discharge ramp means comprises a solid discharge surface extending from about the 8. A separation apparatus which apparatus comprises in combination:

(a) a support frame having a front, back and one and the other sides, with at least one side of said apparatus open to provide an open internal space within the support frame;

(b) an upper grizzly element on the top of the support frame having a one and other end, which grizzly element comprises:

(i) a first receiving hopper means to receive riprap-type material to be separated and which comprises upright, outwardly angled hopper surfaces extending from the one and other sides of the support frame;

(ii) a plurality of generally parallel, spaced apart, horizontally fixed bar elements extending from the front toward the back of the support frame to separate the received riprap into first large riprap material which does not pass through the spaces of the bar elements and small riprap material which passes through the spaces of the bar elements;

(c) hydraulic means to tilt the grizzly element about an axis at the one end between a horizontal position and an upright angle of about 75° to aid in the removal of the first large riprap material from the surface of the bar elements by angular movement of the bar elements of the grizzly element and to provide an angular sloping surface for the discharge of the first large riprap material;

(d) a downwardly angled discharge ramp means adjacent the one end of the grizzly element and having a solid discharge surface which extends from the one end to the back of the support frame and adapted to receive the first large riprap material from the grizzly bar elements and to discharge said large riprap material from the discharge ramp means into a separated first large riprap material of defined size on the ground adjacent the back of the support frame;

(e) a second receiving hopper means within the open space of the support frame which comprises downwardly, inwardly angled hopper surfaces extending from the one and other side of the support frame to direct the small riprap material passing through the upper grizzly element on a defined downward path in said open space;

(f) bar support means extending outwardly from the support frame;

(g) a sloping earthen ramp means which surrounds and encompasses the bar support means to provide an angled ramp for the movement of vehicles so that the vehicles may discharge riprap material to be separated into the first receiving hopper means of said apparatus; and (h) screen-type soil separating means within the said open space to receive said small riprap material from the second hopper means and to separate the small riprap material into a second riprap material and a third riprap material of defined sizes, the third material deposited and separated and reachable for the removal within the said open space and beneath the screen-type soil separating means, and the second material separately deposited and separated outside of the separation apparatus thereby providing an apparatus for the separation of the riprap material into at least three distinct, classified, separate materials.

9. A method of separating riprap material into three, separate, distinctly sized, classified solid material, which method comprises:

(a) providing a sloping earthen ramp means for the movement of vehicles carrying riprap material to be separated;

(b) discharging the riprap material from vehicles using the ramp means directly into a first receiving section of a riprap separation apparatus having a support frame surrounding an internal open space and a tiltable upper grizzly section disposed on the support frame, and the grizzly section composed of a plurality of spaced apart, fixed bar elements at a tiltable angle to the ground to provide for the passage of small riprap material through the bar elements downwardly and the retention of first large riprap material;

(c) discharging the large riprap material from the angled surface of the bar elements outside of said frame as a first riprap material;

(d) adjustably tilting at a defined angle the grizzly section to aid in discharging large size riprap material from the surface of the bar elements and to inhibit the retention of riprap material between the bar elements;

(e) directing the downwardly flowing small riprap material from the grizzly section into a screen-type soil screening apparatus within the said open space and comprising at least two spaced apart, angled, upper and lower shaker screens;

(f) separating the small riprap material into a third material by passing the material downwardly through the upper and lower shaker screens into the said open space; and (g) discharging from the angled, upper shaker screen outside of the soil screening apparatus a second material which fails to pass through the shaker screen, thereby providing for classification of the riprap material into three separate, distinct size classified materials.

10. The method of claim 9 which includes separating riprap material into a first riprap material of greater than about 12" in size, to a second material between about 6" and 18" in size and a third material of less than about 6" in size.

11. The method of claim 9 which includes tilting the grizzly section at an angle from about 20° to 75° from horizontal.

12. The method of claim 9 which includes discharging the first large riprap material from the upper grizzly section onto an adjacent, downwardly angled discharge ramp and into a segregated pile of the first large riprap material outside of the support frame.

13. The method of claim 9 which includes securing the riprap separation apparatus to the sloping earthen ramp means.

14. The method of claim 13 which includes securing the riprap separation apparatus to the ramp means by surrounding support bars extending from the riprap separation apparatus with the earth of the ramp means.

* * * * *

UNITED STATES PATENT AND TRADEMARK OFFICE

CERTIFICATE OF CORRECTION

PATENT NO. : 4,998,625

DATED : March 12, 1991

INVENTOR(S) : James L. Read

It is certified that error appears in the above-identified patent and that said Letters Patent is hereby corrected as shown below:

Column 6, line 7 delete "form" and insert --from--;

Column 7, line 3 the following words have been omitted: --one end of the upper grizzly element to the back of the support to direct large riprap material outside of the support frame.--.

Signed and Sealed this

Twenty-eighth Day of July, 1992

*Attest:*

DOUGLAS B. COMER

*Attesting Officer*

*Acting Commissioner of Patents and Trademarks*